United States Patent [19]

Linka

[11] 4,410,017

[45] Oct. 18, 1983

[54] METHOD AND APPARATUS FOR PNEUMATIC INSERTION OF A WEFT THREAD IN THE SHUTTLE OF A MULTI-FEED WEAVING LOOM

[76] Inventor: Adolf Linka, Untere Dornäcker 4, Bechtoldsweiler, D-7450 Hechingen 6, Fed. Rep. of Germany

[21] Appl. No.: 333,859

[22] PCT Filed: Apr. 18, 1981

[86] PCT No.: PCT/DE81/00064

§ 371 Date: Dec. 11, 1981

§ 102(e) Date: Dec. 11, 1981

[87] PCT Pub. No.: WO81/03037

PCT Pub. Date: Oct. 29, 1981

[30] Foreign Application Priority Data

Apr. 26, 1980 [DE] Fed. Rep. of Germany ..... 3016182

[51] Int. Cl.[3] ..... D03D 47/26

[52] U.S. Cl. ..... 139/436

[58] Field of Search ..... 139/436, 224 R

[56] References Cited

U.S. PATENT DOCUMENTS

| | | | |
|---|---|---|---|
| 3,319,663 | 5/1967 | Fend | 139/436 |
| 3,943,976 | 3/1976 | Vilaseca | 139/436 |
| 4,132,248 | 1/1979 | Steiner | 139/436 |
| 4,253,498 | 3/1981 | Luchi | 139/436 |

FOREIGN PATENT DOCUMENTS

| | | | |
|---|---|---|---|
| 1287526 | 3/1964 | Fed. Rep. of Germany | 139/436 |
| 1288025 | 1/1969 | Fed. Rep. of Germany | 139/436 |
| 2800639 | 8/1979 | Fed. Rep. of Germany | 139/436 |
| 2429276 | 1/1980 | France | 139/436 |

*Primary Examiner*—Henry Jaudon

*Attorney, Agent, or Firm*—Frishauf, Holtz, Goodman & Woodward

[57] ABSTRACT

A method for the pneumatic insertion of the weft thread (24, 24*a*) into the shuttles (9) of a multi-feed weaving loom. The weft thread (24, 24*a*), of a respectively predetermined length, is inserted by means of an air flow in an injector (23) into the weft thread magazine (29) of a shuttle (9) traveling in a continuous movement past the injector (23).

In order to be able to supply the shuttles (9) rapidly with the particular weft thread required for the fabric panel width in a multi-feed weaving loom, without thereby causing an impermissible strain on the weft thread or being required to extend the length of the weft thread magazine (29) of the shuttles (9), the injector (23) is moved conjointly with the shuttle, e.g. by a gear coupling (34–38) beginning at a start position (I) but, at a slower speed than the shuttle and over shorter distance during the insertion of the thread (24, 24*a*) into the weft thread magazine (29). At the end of this distance the injector is rapidly returned to the start position by a spring (42).

24 Claims, 7 Drawing Figures

Figure 1:
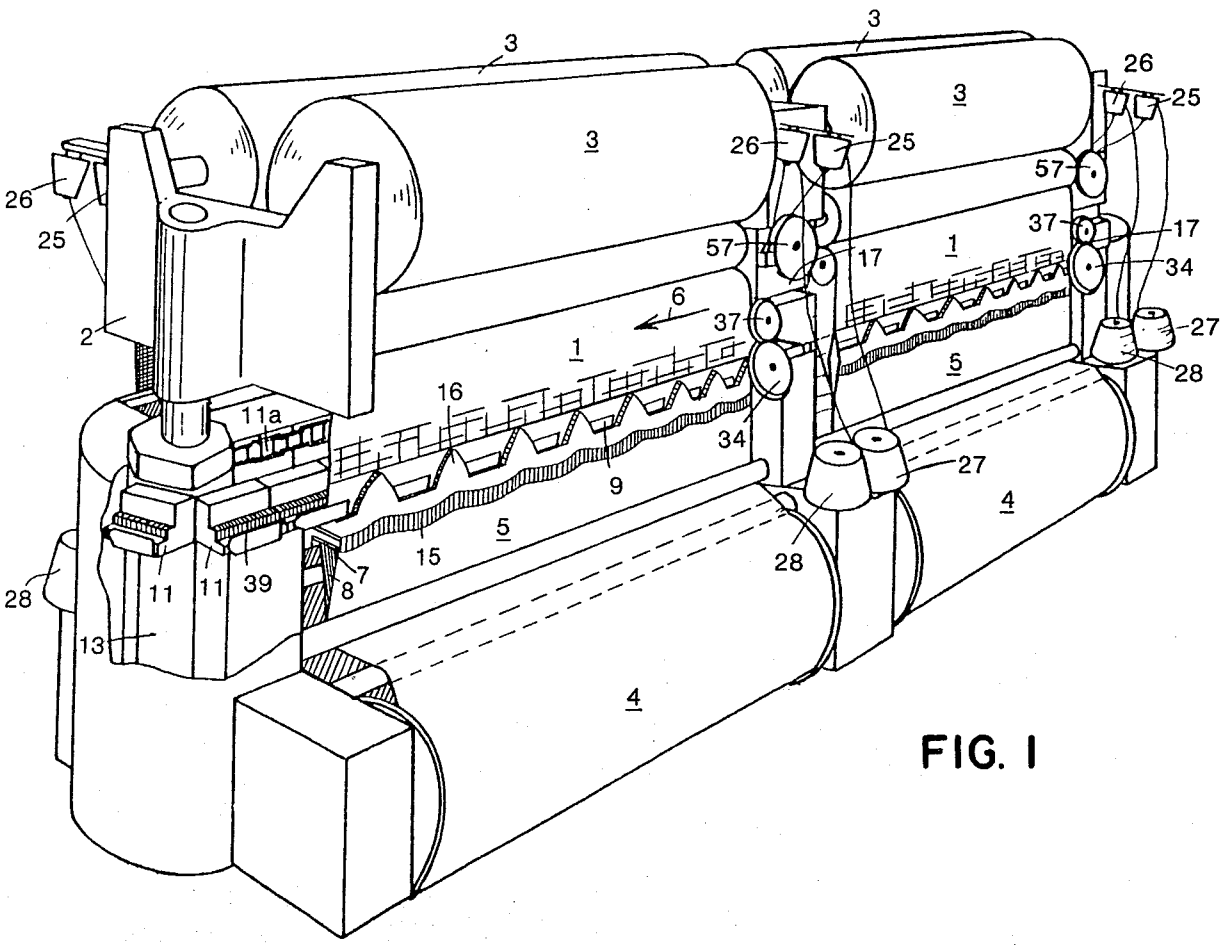

METHOD AND APPARATUS FOR PNEUMATIC INSERTION OF A WEFT THREAD IN THE SHUTTLE OF A MULTI-FEED WEAVING LOOM

The invention relates to a method for pneumatic insertion of the weft thread in the shuttle of a multifeed weaving loom, in which the weft thread, measured out in a predetermined length, is introduced by an air flow in an injector into the weft thread magazine of a shuttle traveling past the injector in continuous motion.

The invention furthermore relates to an apparatus for performing this method, which has an injector exposed to compressed air, to which the weft thread can be delivered from a thread measuring and delivery apparatus. The injector is disposed in the vicinity of the movement path of the shuttle of a multi-feed weaving loom in such a way that the weft thread can be introduced into the weft thread magazine of a shuttle passing the injector at that time.

BACKGROUND

In multi-feed weaving looms, a plurality of shuttles operate simultaneously, being moved while spaced apart from one another by the smallest possible distances. High weft-thread insertion performance is thus attained even at a relatively low shuttle speed. The short distances by which the shuttles follow one another necessitate a correspondingly short time sequence in supplying weft threads to the shuttles. In the case of shuttles operating with weft thread spools, a disproportionately great expense is required for constructing the shuttle supply means, which makes the utility of the entire multi-feed weaving loom uncertain.

In weaving looms with pneumatic insertion of the weft thread into the weft thread magazine of a particular shuttle (the magazine being embodied in the form of a chamber penetratable by air), it is possible with very simple technical means to attain a substantially better weft-thread insertion performance than would be the case if weft thread spools were used. The weft thread, measured out to a particular length, is then blown into the weft thread magazine by means of an injector through which a current of air flows. The length of the weft thread equals the width of the panel of fabric being woven, and the shuttle is supplied with a new weft thread between each two adjoining fabric panels.

The weft thread being introduced into the weft thread magazine of a shuttle is unwound from a cross wound spool or from a thread storage device located downstream of the spool. Ballooning of the thread then unavoidably occurs, being caused by the unwinding thread as it travels crosswise with respect to the direction in which thread is fed to the shuttle and thus intersects the air flow. Since air resistance increases with the square of the speed, the weft thread is subjected to severe strain, and its tear strength limits the speed with which it can be unwound.

In order to reduce the unwinding speed of the weft thread, it would be conceivable in principle to lengthen the weft thread magazine of an individual shuttle, in order to increase the length of time required for filling the weft thread magazine. However, this is not practicable, since longer shuttles are then used, correspondingly fewer feed systems or shuttles can be accommodated in the weaving loom, so that the loom output would drop.

The invention:

It is accordingly an object of the invention to provide a method and apparatus for rapid supply of thread to the shuttles of a multi-feed weaving loom by pneumatic means, within a short distance shuttle movement path and with the correct weft thread for the intended fabric panel width, without thereby necessitating excessive strain on the weft thread or an extension in length of the weft thread magazine of the shuttles.

In accordance with, the invention, the injector, beginning at an outset position, is carried along with the shuttle at a slower speed for a predetermined distance while the weft thread is being introduced into the weft thread magazine. At the end of this distance the injector is rapidly brought back into its outset position.

There is a certain distance between the individual shuttles because of the shuttle stop and the changing of the shed. Because the injector is carried along with the shuttle while the weft thread is introduced into the weft thread magazine, the fill time available for introducing the weft thread is prolonged by the amount of time which a particular shuttle requires to traverse the distance corresponding to the distance between two adjacent shuttles. If, for instance, the injector is moved along with the shuttle at half the normal speed of the shuttle, and if the distance between two adjacent shuttles equals the length of one weft thread magazine, then the fill time is doubled; this has exactly the same effect as if the injector were stationary and the weft thread magazine of the shuttle were twice as long.

Basically, the difference in speeds of a particular shuttle and of the injector is determined such that there is no accumulation of the weft thread at one point in the weft thread magazine; instead, a uniform distribution of the weft thread in the weft thread magazine is attained. In order to utilize the entire length of the magazine, it is efficacious for the injector to be displaced relative to the shuttle by an amount corresponding to the length of the weft thread magazine while the weft thread is being inserted into the weft thread magazine.

In order to prevent the weft thread from being spun out of the injector as the injector is being rapidly returned to its outset position, it may be efficacious in certain cases for the weft thread to be laterally guided at least partially along its course to the injector; this may be accomplished, for instance, by having the travel path of the thread extend through a preferably transparent plastic tube or a plastic hose.

In producing woven goods containing various weft threads, at least two injectors can be used, each being assigned its own weft thread; one of the injectors is then moved out of the outset position along with the shuttle in order to insert the weft thread into the weft thread magazine, with the other injector or injectors either kept ineffective or rendered ineffective during this process. The result is very simple conditions in which the ineffective injector or injectors is or are held laterally beside the path of movement of the shuttles, and the injector which is to be moved with the shuttle is translated into the appropriate outset position for such a movement before the insertion of the weft thread into the weft thread magazine begins. The injectors may be selected according to a program, for instance, for insertion of the weft thread into the weft thread magazine in accordance with the desired color repeat. An electronic repeat control means may be used for this purpose.

The use of two injectors furthermore permits a further gain in time in filling the weft thread magazine of a particular shuttle. After the insertion of the weft thread into a weft thread magazine has ended, the injector requires a certain period of time for its return to the outset position; if only one injector is used, then this return time cannot be utilized for filling a weft thread magazine. However, if there are two injectors, then while the coupled injector is being returned following the insertion of the weft thread into the weft thread magazine, the second injector can be transferred into the outset position so that it can be carried along with the next subsequent shuttle. It is accordingly possible to begin inserting weft thread into the magazine of the next shuttle, immediately after the weft thread insertion into the first magazine has ended.

When the insertion of weft thread into the weft thread magazine has been completed, the weft thread is cut off at the edge of the fabric. It is particularly efficacious if the end of the weft thread is then automatically retracted into the injector as the injector is being returned to its outset position; this prevents its protrusion from the injector at the beginning of the loading of the next subsequent weft thread magazine, which could otherwise produce tangling and the like.

In accordance with further feature of the invention, the apparatus referred to above for performing the new method has the injector movably supported along a portion of the movement path of the respective shuttle and coupled with a driver mechanism, which is synchronized with the movement of the shuttle. By this driver mechanism, it is possible to impart to the injector a coupled movement with the shuttle which is effected at a predetermined speed-reduction ratio to the speed of the shuttle, at least during the process of insertion of the weft thread into the weft thread magazine of a particular shuttle and over a predetermined distance beginning at an outset position.

To this end, a sliding guide on which the injector is displaceably supported may be disposed in the vicinity of the movement path of the shuttle in one preferred practical form of embodiment. This sliding guide efficaciously comprises two parallel guide rails, between which the injector, having a fitted sliding piece, is guided.

With a view to the drive of the injector, the arrangement may be such that the driver mechanism has a coupler, which can automatically be brought into engagement with the injector as the latter is in its outset position; after the predetermined distance has been traversed by the injector, the coupler can be automatically uncoupled from the injector. The injector is coupled with a restoring device which then becomes effective and returns the injector to its outset position; the restoring device may have a restoring spring which is tensed during the course of the coupled movement of the injector.

Very simple and reliable structural conditions are attained if the coupler is disposed on a chain which has one stringer parallel to the path of movement of the injector and which is moved at the predetermined speed-reduction ratio to the movement of the shuttle. At the beginning and end of the movement path of the injector, this chain is guided over deflecting rollers, by means of which the coupler is movable toward the injector to engage it or away from the injector to disengage it.

The drive mechanism (that is, the chain) is efficaciously driven via a gear mechanism which engages a gear disposed on a portion of the shuttle drive which is moved in common with a particular shuttle.

In a preferred exemplary embodiment, a plurality of couplers is disposed on the chain, the distance between them being greater than the path of the injector by an amount which enables the return movement of the injector to its outset position. The length of time during which the injector is engaged by one of the couplers equals the fill time. As soon as the insertion procedure is ended, the coupler releases the injector, so that it can be rapidly retracted into its outset position; from there, it is moved synchronously along with the next subsequent shuttle, either by the same coupler of the chain or by the next subsequent coupler.

In order to assure that the severed end of the weft thread, as already noted above, will not protrude from the injector as the injector is being returned to its outset position, it is efficacious for a thread guide element to be disposed in the thread path taken by the weft thread toward the injector. By this means, the weft thread is held firmly, at the termination of its insertion into the weft thread magazine, at a point from which the thread path to the injector which has been returned to its outset position is longer than the path to the injector which has been carried along with the shuttle to the end of its own path.

As has also been noted above, the apparatus may have a plurality of injectors each of which is associated with its own weft thread; then each injector is capable of being coupled selectively with the driver mechanism. The injectors may be disposed beside one another at the side of the movement path of the shuttle, and one injector at a time can be translated by an adjusting device into the outset position for coupled movement.

If the apparatus includes a sliding guide having guide rails, then the injectors can each be disposed between two guide rails, while the guide rails themselves are adjustably supported transversely to the movement path of the shuttles. As soon as the weft thread insertion into a weft thread magazine has been completed and the magazine has left the injector, the guide rails are adjusted laterally, so that the now-ineffective injector can return unhindered to its outset position, while the injector intended for the next subsequent filling of a weft thread magazine assumes the outset position for its coupled movement and there comes into engagement with the driver mechanism.

When weft yarn whose strength permits a high thread unwinding speed is used, so that it is not necessary to prolong the fill time of the weft thread magazine, then the injectors may also be disposed in a register which is adjustably supported transversely to the path of shuttle movement. After a particular filling process, the register is displaced, during the interval until the next subsequent weft thread magazine is to be filled, such that the injector having the desired color of weft thread is brought into the outset position for coupled movement with the next subsequent shuttle. This adjustment of the register may be effected by way of example via a gear wheel drive which is automatically dependent on the movement of the shuttles in accordance with a program contained on a suitable program carrier, such as a punch card or a wiper chain or a memory element.

The injectors may also be preceded by an apparatus for measuring and supplying thread which has a continuously driven thread drum; the weft threads of the injectors can be pressed at intervals against the surface of this apparatus, this pressing movement of the individual pressure rollers being automatically dependent on the movement of the injectors.

Each injector is assigned its own pressure roller, which supplies the weft thread to the injector in accordance with a program. The axial length of the supply drum is dimensioned such that the required number of pressure rollers can come into action one beside the other.

As noted above, the described coupled movement of a particular injector with the shuttle while the weft thread is being inserted into its weft thread magazine prolongs the weft thread magazine fill time, as described; the desired prolongation is attained in accordance with the selected speed-reduction ratio between the shuttle and the coupled injector. However, if the weft thread unwinding speed is kept constant, then in the same manner the travel speed of the shuttles can be increased accordingly in comparison with conditions prevailing with a stationary injector; or another alternative as a comparison is the insertion of a double length of weft thread into the weft thread magazine, which makes it possible to produce correspondingly wider fabric panels with the same weft thread supply speed. In so doing, care should be taken that a correspondingly greater number of shuttles than be used for the fabric, and this likewise increases the loom output accordingly.

DRAWINGS

Figure 2:
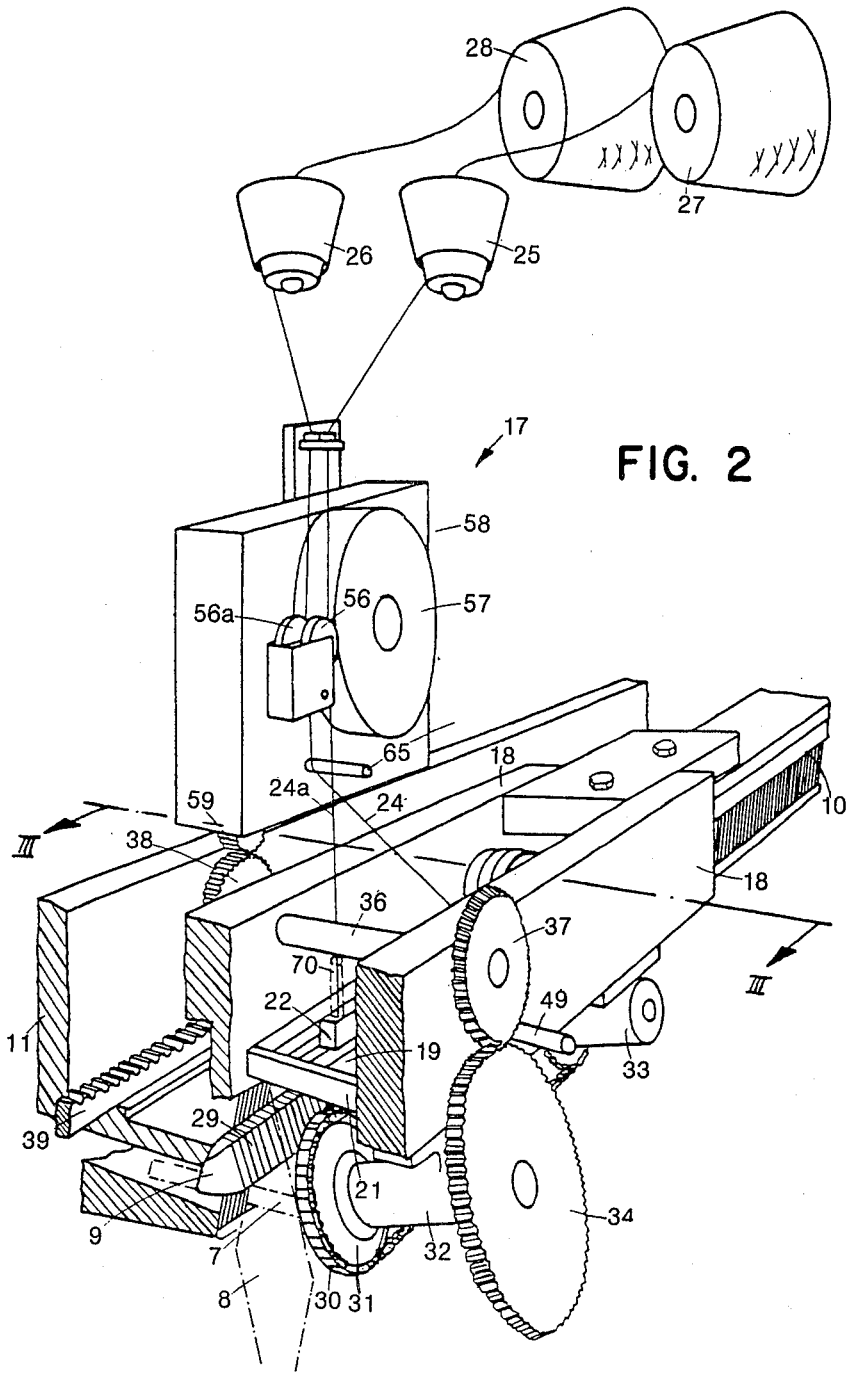
Figure 3:
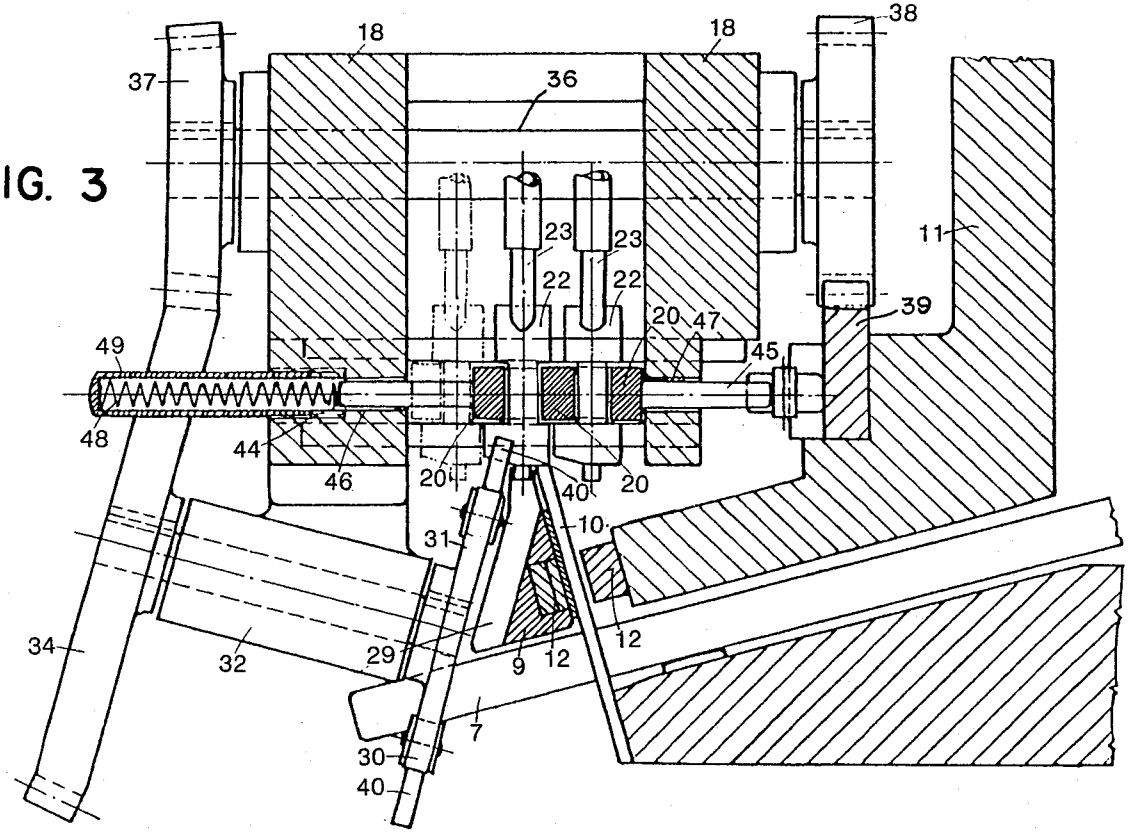
Figure 4:
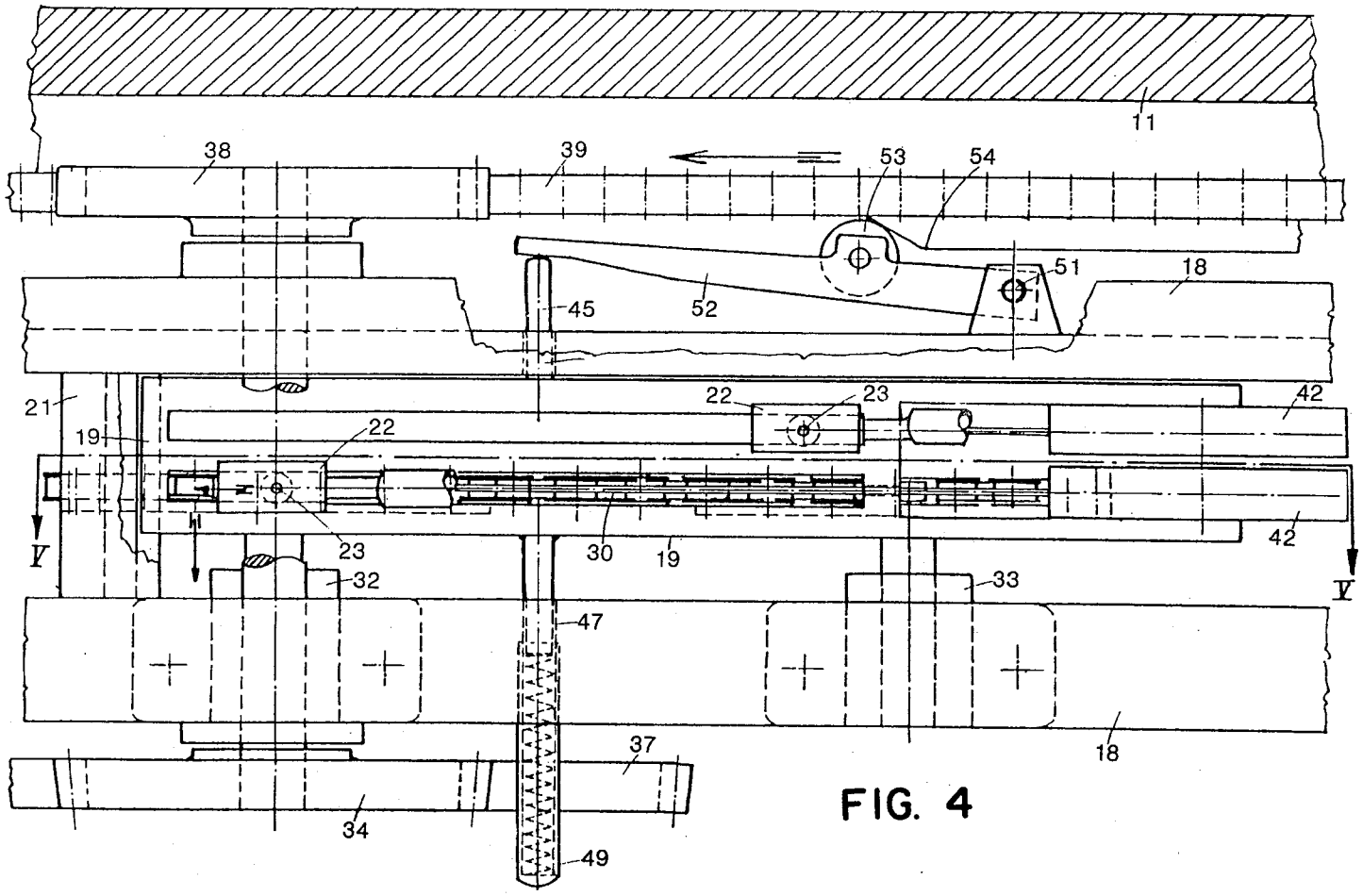
Figure 5:
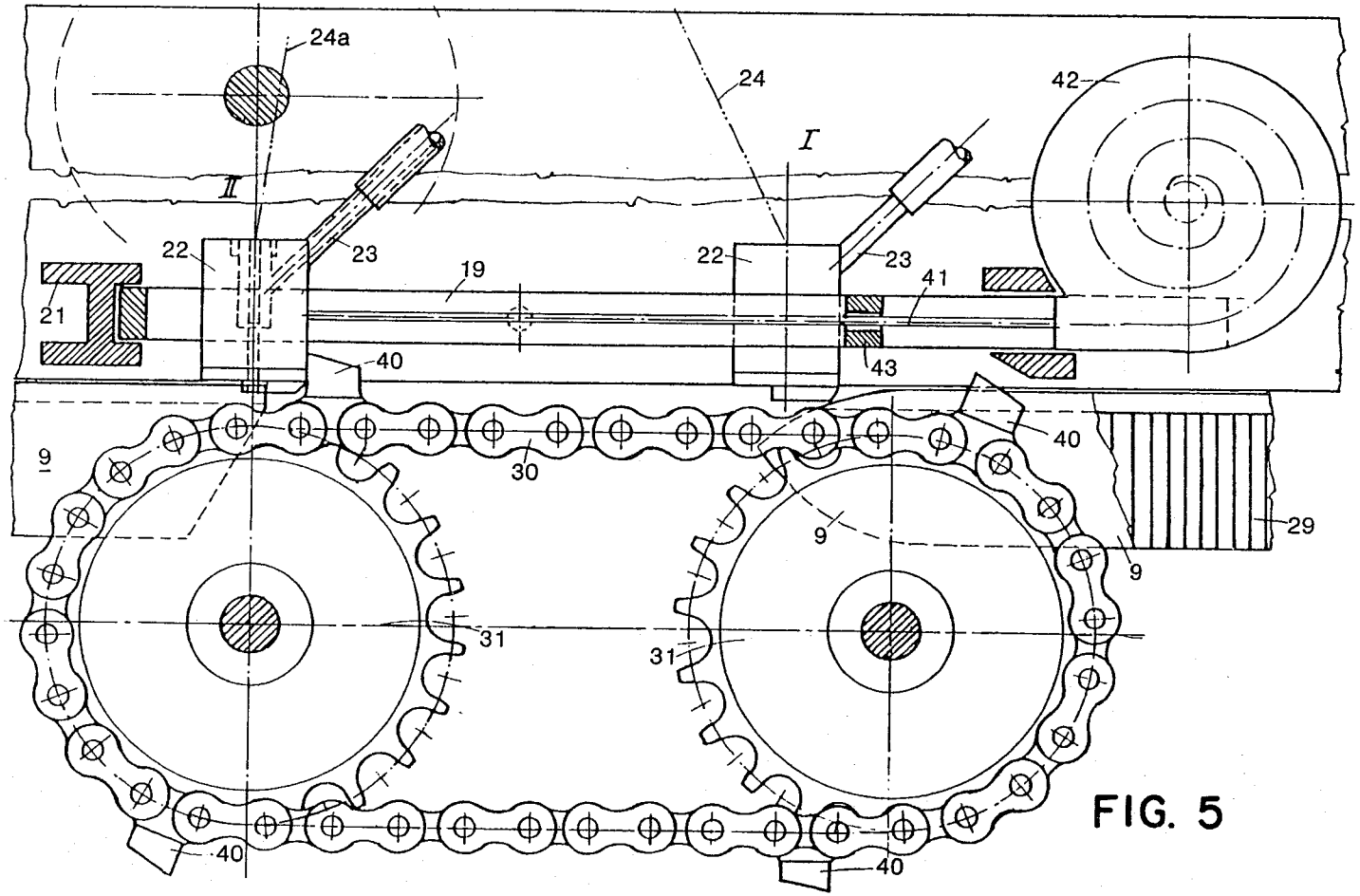
Figure 6:
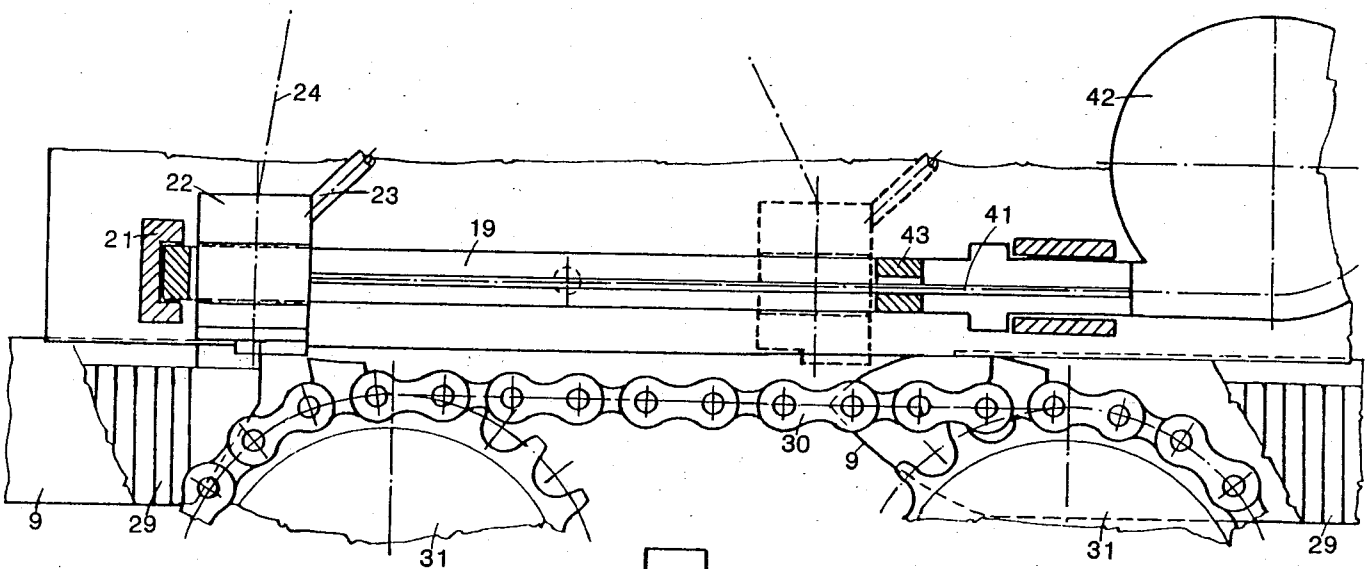
Figure 7:
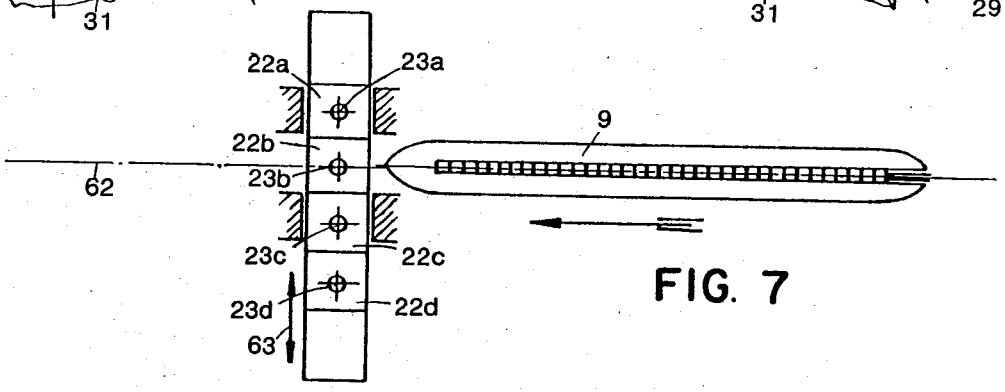

Shown are:

FIG. 1, a multi-feed weaving loom having devices according to the invention for inserting the weft thread into the weft thread magazine of the shuttles, seen in a perspective view;

FIG. 2, an apparatus for inserting the weft thread of the weaving loom as shown in FIG. 1, in a perspective view;

FIG. 3, the apparatus of FIG. 2 in a lateral view, in a section taken along the line III—III of FIG. 2;

FIG. 4, a plan view and detail of the apparatus of FIG. 3;

FIG. 5, a lateral view of the apparatus of FIG. 2, in a section taken along the line V—V of FIG. 4;

FIG. 6, the apparatus of FIG. 2 in a modified form of embodiment having only one injector, seen in a view corresponding to that of FIG. 2; and FIG. 7, an injector register for a further modified form of embodiment of an apparatus according to the invention, seen in a schematic plan view, together with a shuttle.

In FIG. 1, a multi-feed weaving machine is shown, of the double-flat or "back-to-back" type. The machine is set up for the simultaneous production of four fabric panels 1, which are each wound up to make a bolt of goods 3 supported on the machine frame. The warp threads 5 unwound from the warp beams 4, which are rotatably supported on the bottom of the machine frame 2, are spread apart, moving in the direction of an arrow 6, by heddles 7 movable transversely relative to the fabric panel 1, forming sheds 8. Each shed is traversed by a shuttle 9, the shape of which is shown in detail and by way of example in FIGS. 2 and 7.

The shuttles 9 travel one after another, at a predetermined spacing. They travel, as shown in FIGS. 1 and 3 along a guide path formed on one side by a reed 10 and on the other by the shafts of the heddles 7. The drive of the shuttles is effected via block-like segments 11 movably guided along the machine frame 2 and magnetically coupled with the individual shuttles 9 via permanent magnets 12. The segments 11 are secured on an endless chain 11*a* (FIG. 1) such that they abut one another at their ends and are guided via two vertical, polygonal driver rollers 13 rotatably supported in the machine frame 2, as may be seen in FIG. 1. On their underside oriented toward the heddles 7, the segments 11 carry guide surfaces, not shown in detail, into which protrude feet formed on the shafts of the heddles 7. This arrangement is generally shown in U.S. Pat. No. 3,749,135 and in German Pat. No. 1,963,208.

Between the reed 10, weft thread beater plates 15 protrude through the warp threads toward the outside and serve to beat down the inserted weft thread between sequential shuttles 9, as indicated at 16 in FIG. 1.

The machine has, by way of example, eight shuttles 9 per fabric panel 1, or in other words eight feed systems.

The insertion of the weft thread into the shuttles 9 is effected in the area located between two adjacent fabric panels 1 by means of a weft thread insertion device 17 associated with each fabric panel; one such insertion device is shown in detail in FIGS. 2–5, and the machine shown in FIG. 1 has four such devices.

The weft thread insertion device 17 shown in these figures has a sliding guide 19 supported on two parallel main carriers 18 of the machine frame 2. The sliding guide 19 comprises three parallel guide rails 20 (FIG. 3) disposed at a predetermined distance from one another and firmly interconnected, which, extending parallel to the main rails 18, are supported in a transversely movable manner at their ends in two cross rails 21 secured on the main rails 18. One sliding piece 22 is fitted into place between each two guide rails 19 and carries an injector 23 (FIGS. 3 and 6) to which a weft thread 24 is delivered. The weft thread 24 comes from a thread supply device shown at 25 or 26, which in turn unwinds the thread from a cross wound thread package 27 or 28. As may be seen from FIG. 3, the injector 23, there shown in the center, discharges in the immediate vicinity of the weft thread magazine, shown at 29, of the shuttle 9.

Extending below the sliding guide 19, at the side along the warp threads defining the shed 8, is the upper run of an endless chain 30, (FIGS. 2, 3, 6) which is guided over two rollers 31 rotatably supported on appropriate shafts 32 and 33, respectively, on one of the main carriers 18. One of the rollers 31 is connected with a gear wheel 34 in a rotationally fixed manner, and the gear wheel 34 engages a gear wheel 37 seated on a shaft 36 supported in the main carriers 18. This gear wheel 37 is in turn connected in a rotationally fixed manner with a gear wheel 38 located on the other side of the main carriers 18 by way of the shaft 36. The gear wheel 38 engages a rack 39 made up of individual rack segments each having the length of one of the segments 11 to which they are secured.

As may be seen from FIG. 1, the result is thus a continuous rack 39 extending over the length of the weaving machine, which moves past the gear wheels 38 of the weft thread insertion devices 17 with the speed of the segments 11 and thereby drives the respective chain 30, via the gear wheels 38, 37, 34, at a speed which is synchronized with the movement of the shuttles 9 magnetically coupled with the segments 11. The relative speed of the chain 30 with respect to the shuttles 9 is determined by the reduction of the gear wheel mechanism 34–38.

As may be seen from FIG. 5, the chain 30 carries four coupler teeth 40 in the illustrated exemplary embodiment; these teeth are disposed at uniform distances apart from one another. The upper run of the chain 30 is disposed parallel to the sliding guide 19 in such a manner that each coupler 40 is capable of engaging the sliding piece 22 of the injector 23, shown in the center (FIG. 3) in a starting position I (FIG.5), and displacing it along the sliding guide 19 into a terminal position II via a path of predetermined length. A particular coupler is brought by the right-hand deflection roller 31 radially up to the sliding piece 22, which is in the outset position I, in the manner shown in FIG. 5 and brought into engagement with the sliding piece 22; on the other side, the left-hand deflection roller 31, in the terminal position II, carries the coupler 40 radially away from the sliding guide 19 again and thus automatically disengages it from the sliding piece 22.

Each of the injectors 23 is connected with a restoring device, which is embodied in the form of a pull-in spring 41 engaging the injector and anchored at one end in a housing 42. The spring 41 is associated with a stop 43, against which the sliding piece 22 rests when in its starting position I and which limits the return movement of the sliding piece.

The sliding guide 19 carries two laterally protruding coaxial bolts (FIGS. 2, 4) 44, 45, which are displaceably guided in corresponding bores 46, 47 of the main carrier 18. One bolt 44 on the outside of the main carriers 18 is under the influence of a compression spring 48, which is supported at the end against the bottom of a spring sheath 49 inserted in the associated main carrier 18 and presses the sliding guide 19 into the right-hand stop position (as seen in FIG. 3) on the opposite main carrier 18.

The other bolt 45 is supported at its end against a two-armed lever FIG. 4 52 pivotably supported at 51 on a main carrier 18; it carries an engagement roller 53, which is engageable with a cam track 54 disposed laterally on the respective segment 11 in the vicinity of the rack 39 (FIG. 4).

Operation:

Each of the injectors 23 is associated with its own weft thread 24 or 24*a* (FIG. 2), which can be pressed by a pressure roller 56 or 56*a* against the circumference of a thread supply drum 57, rotating at a constant speed, of a weft thread measuring and supplying device 58 associated with the weft thread insertion device 17 in accordance with a program. The control of the pressing movement of the pressure rollers 56, 56*a* is effected via a gear wheel 59 engaging the gear wheel 38 and is compulsorily dependent on the movement of the shuttles. The two pressure rollers 56, 56*a* are individually triggerable in accordance with a program.

The shuttles 9, driven by the segments 11, travel through their respective sheds at a predetermined distance apart from one another and at a predetermined speed determined by the speed of gear 38. If a shuttle 9 enters the vicinity of a weft thread insertion device 17, as is shown at the right in FIG. 5, one of the injectors 23 (in FIG. 3, the one on the right) is in the starting position I in which it is located in the path of movement of the coupler 40. Beginning at this starting position I, the injector 23 is carried along by a coupler 40 at the speed determined by the gearing 34–38 and is transferred at a second, slower predetermined speed, but in synchronism with the movement of the shuttle 29, into the terminal position II, where the coupler 40 is disengaged from the sliding piece 22. The movement of the coupler 40 is adapted to that of the shuttle 9 in such a manner that the injector 23 carried along by a coupler 40 is moved along with the shuttle 9 on the injector's path from the starting position I to the terminal position II. The speed-reduction ratio between the chain 30 and the shuttle 9 is selected to be such that during this coupled movement of the sliding piece 22, the injector 23 is displaced relative to the shuttle 9 by the length of the weft thread magazine.

During this coupled movement of the injector 23 with the shuttle 9, the pressure roller 56 or 56*a* associated with the weft thread 24 or 24*a* being inserted into this injector is pressed against the thread supply drum 57, so that weft thread is inserted from this drum into the injector 23 and then in turn is blown at the mouth of the injector 23 into the weft thread magazine 29 of shuttle 9 which is penetrable by air. As soon as the insertion of the weft thread is ended and the injector 23 has reached its terminal position II, the weft thread is cut off at the edge of the fabric by a cutting device, not illustrated further, after first being partially woven in and held firmly in place and then carried farther into the shed of the fabric panel 1 by the shuttle 9 as its movement continues. Since the spring 41 has been tensed during the coupled movement of the injector 23 with the shuttle 9, the sliding piece is returned instantly by the spring 41 upon its release from the coupler 40, to the start position I in which it rests on the stop 43.

The partial circular circumference of the gear wheel 38 is exactly equal to the length of one weaving feed system (or to a multiple thereof). The gear wheel 34 is thus driven at a reduction ratio of 2:1, the spacing of the couplers 40 on the chain 30 in the illustrated embodiment equalling one-fourth of the length of the system. Thus, given a system length of 24 cm, a coupler moves a distance of 12 cm between the two positions I and II.

If the length of the weft thread shuttle magazine 29 is 10 cm, then given the reduction of 2:1 the injector 23 accompanies the weft thread magazine 29 between positions I and II for a distance of 10 cm; this means that a distance is available for the insertion of the weft thread into the weft thread magazine 29 which corresponds to a weft thread magazine length of 20 cm. Since the interval between couplers 40 equals 12 cm and the injector 23 is moved a distance of only 10 cm while the weft thread is being inserted, a remaining distance of 2 cm is still available. This remaining distance is utilized for returning the sliding piece 22 and thus the injector 23 out of its terminal position II into the starting position I in the free time thus available, by means of the spring 41, as has been explained. This assures that the sliding piece 22 is properly located in the start position I before it is brought into engagement with the next coupler 40 and again carried into the terminal position II.

The insertion of weft thread as described above can be still further improved by using the remaining time mentioned above which is required for returning the injector 23 from its terminal position II into its outset position I. To this end, the second injector is used as shown in FIGS. 3–5:

When the left injector 23 shown in FIG. 5 (which corresponds to the middle injector of FIG. 3) reaches its terminal position II, the pressure roller 53 rolls off on the cam track 54 of segment 11 as may be seen in FIG. 4. Thus as the segment 11 continues to move, the sliding guide 19 is displaced via the lever 52 and the bolt 45 toward the left (in terms of FIG. 3), so that the injector 23, in this case on the right, is transferred with its sliding piece 22 out of the position of rest at the side of the chain 30 and into the start position I, in which its sliding piece 22 is located in the movement path of the couplers 40. At the same time, the injector 23 located in the terminal position II, which has terminated the insertion of weft thread, is disengaged from its coupler 40, so that it can travel back to the stop 43, by passing the couplers 40 and the chain 30 at the side. Meanwhile, the second injector is already carried along by its coupler 40 and thus begins the process of weft thread insertion. The position which the first injector 23 assumes upon its return, at the side next to the chain 30, is indicated by broken lines at the left in FIG. 3.

Once the second injector has completed its weft thread insertion, the pressure roller 53 again rolls off on the cam track 54, so that the sliding guide 19 moves toward the right (as seen in FIG. 3), and the first injector is accordingly engaged in turn by the next subsequent coupler tooth 40 at its sliding piece 22, while the other injector, now ineffective, is located at the side, next to the chain 30, as shown at the right in FIG. 3. The two injectors 23 are thus put to use for weft thread supply in alternation.

When a plurality of injectors 23 is used, the control can be effected in accordance with a program, for instance by means of a programming unit, so that a change in weft thread color can be performed by means of the injectors 23. The sliding guide 19 is then guided over a suitable adjusting device via a rack and a gear wheel by the programming unit, causing the reciprocating movement of the sliding guide 19 effected by the two-armed lever 52.

Naturally it is also possible in principle, in a simple form of embodiment, to embody the weft thread insertion device 17 such that it functions with only one injector 23, instead of the exemplary embodiment having at least two injectors 23 described above. This simpler embodiment is shown schematically in FIG. 6. Identical elements are identified by identical reference numerals, so that another explanation would be superfluous.

Finally, another form of embodiment is shown in FIG. 7 in which four injectors, identified as 23*a* through 23*d*, are combined with their pressure pieces 22*a* through 22*d* to make one array, or assembly, which like its sliding guide 19 is adjustable, in accordance with a program, transversely to the movement path 62 of the shuttle 9. It is thus possible to supply shuttles 9 arriving in sequence with four difference weft threads. The reciprocating displacement, indicated by an arrow 63, of the array formed by the injectors 23*a*–23*d* is effected in accordance with a program via a programming unit and an adjusting device triggered by the programming unit.

The invention was described above in terms of a double-flat weaving machine. In principle it is also inherently applicable to a circular weaving machine or one with some other design.

Between the thread supply drum 57 and the associated injector 23, a thread guide element 65 in the form of a stationary pin (FIG. 2) is provided, which is disposed such that the thread travel path from the pin 65, which firmly holds the weft thread, to the injector 23 in its starting position I is longer than the path to the injector located in its terminal position II. As a result, after the weft thread has been severed at the injector 23, which is in its terminal position II, the severed end of the weft thread is drawn into the injector during the return movement of the injector 23 into its outset position I and thus does not protrude downward out of the injector.

Also, as shown in FIG. 2, a tube 70 is mounted on the injector 23; it may also be embodied as a flexible hose, as needed, and is preferably transparent. This tube 70 assures a lateral guidance of the weft thread 24 or 24*a* on the path between the thread supply drum 57 and the associated injector 23, so that the weft thread cannot inadvertently escape from the injector.

I claim:

1. A method for the pneumatic insertion of a weft thread into the shuttle of a multi-feed weaving loom in which the weft thread, measured out at a predetermined length, is inserted by means of an air flow in an injector into a weft thread magazine of a shuttle continuously moving past the injector, characterized in that the injector, beginning at a start position, is moved along with the shuttle for a predetermined distance at a reduced speed during the insertion of the weft thread into the weft thread magazine, and at the end of this distance is rapidly returned to the position.

2. A method as defined in claim 1, characterized in that during the insertion of the weft thread into the weft thread magazine, the injector is displaced relative to the shuttle by an amount corresponding to the length of the weft thread magazine.

3. A method as defined by claim 1, characterized in that the weft thread is at least partially guided laterally on its way to the injector.

4. A method as defined by claim 1, characterized in that at least two injectors are provided, each of which is associated with its own weft thread, and that one of the injectors at a time is moved out of the outset position for insertion of the weft thread into the weft thread magazine coupled with the shuttle, and the remaining injector or injectors is or are kept ineffective during this period.

5. A method as defined by claim 4, characterized in that the ineffective injector or injectors is or are held at the side, next to the movement path of the shuttles, and the injector to be moved along with the shuttle is transferred into the appropriate start position for the movement before the insertion of the weft thread into the weft thread magazine is begun.

6. A method as defined by claim 4, characterized in that during the return of the coupled injector, after completion of the insertion of the weft thread into the weft thread magazine, a second injector is transferred into the start position for the coupled movement with the next subsequent shuttle.

7. A method as defined by claim 4, characterized in that the injectors are each selected in accordance with a program for the insertion of the weft thread into the respective weft thread magazines.

8. A method as defined by claim 1, characterized in that the weft thread, at the completion of insertion into the weft thread magazine, is severed at the fabric edge and, upon the return of the injector into the start position, the end of the weft thread is automatically retracted into the injector.

9. An apparatus for pneumatic insertion of a weft thread into the shuttle of a multifeed weaving loom having an injector (23) exposed to compressed air to which the weft thread (24, 24*a*) can be delivered from a thread measurement and supplying apparatus (56, 56*a*, 57) and which is disposed near the movement path of the shuttles (9) of the multi-feed weaving loom in such a manner that the weft thread can be inserted into a weft thread magazine (29) of one shuttle (9) at a time traveling past the injector, characterized in that the injector (23) is movably supported along a portion of the movement path of the respective shuttle (9); a driver mechanism (30, 40) is coupled to the injector, movement of the injector being synchronized with the movement of the shuttles (9) to provide for coupled movement of the shuttle (9) with the injector (23) at least during the insertion of the weft thread (24) into the weft thread magazine (29) of the respective shuttle (9), said driver mechanism controlling movement of the injector beginning at a start position (I), then extending over a predetermined distance (I–II) to a terminal position (II);

and means (34–38) for effecting said coupled movement of the injector (23) at a predetermined lower speed with respect to the speed of the shuttle (9).

10. An apparatus as defined by claim 9, characterized by a sliding guide (19), disposed in the vicinity of the path of movement of the shuttles (9), the injector (23) being displaceably supported on the guide.

11. An apparatus as defined by claim 10, characterized in that that the sliding guide (19) comprises two spaced parallel guide rails (20);

and means (22) sliding on said guide rails supporting the injector (23), between said guide rails.

12. An apparatus as defined by claim 9 characterized in that the driver mechanism has a coupler (40) automatically engageable with the injector (23), located in the start position (I), the coupler (40) being capable of being automatically uncoupled from the injector (23) after traveling the predetermined distance (I–II) of the injector (23), and that a restoring device (41, 42) is provided, coupled to the injector for returning the injector to its start position (I) after having been moved over said predetermined distance.

13. An apparatus as defined by claim 12, characterized in that the restoring device comprises a restoring spring (41) capable of being tensed in the course of the movement of the injector (23).

14. An apparatus as defined by claim 12, further characterized by a drive chain (30), the coupler (40) being located on the chain (30); roller means (31) guiding a run of the chain parallel to the path of movement of the injector (23) at the predetermined lower speed with respect to the movement of the shuttle (9) including two rollers (31) located, respectively at the beginning and end of the movement path (I–II) of the injector (23), the coupler (40) on the chain being movable for engagement with the injector (23) to engage it to control its movement and away from the injector (23) for disengagement therefrom after the injection has been moved to the terminal position.

15. An apparatus as defined by claim 12 characterized in that a plurality of couplers (40) are disposed on the chain (30), the distance between couplers being greater than the length of the path (I–II) of the injector (23) by an amount enabling the return of the respective injector (23) to the outset position (I) within the time of movement of the shuttle in its weft insertion path.

16. An apparatus as defined by claim 9 characterized in that the driver mechanism includes said means for effecting the coupled movement of injector (23) and shuttle (9) and comprises a gear mechanism (34, 37, 38) and a rack (39) the shuttle being coupled to the rack for movement therewith and conjointly with the injecctor (23).

17. An apparatus as defined in claim 9 characterized by a thread guide element (65), disposed in the path of thread travel of the weft thread (24, 24*a*) to the injector (23), said thread guide element (65) being located in the thread travel path to the injector (23) at a position such that the path of weft thread to the injector (23), when in start position (I) is longer than the distance to the injector (23) whem moved to the terminal end (II).

18. An apparatus as defined by claim 9 characterized in that a plurality of injectors (23) are provided each of which is associated with its own weft thread (24, 24*a*) and is selectively engageable with the driver mechanism (30, 40).

19. An apparatus as defined by claim 18, characterized in that the injectors (23) are disposed beside one another at the side of the path of movement of the shuttles (9); and moveable guide means (45, 52, 54) for transferring one injector at a time into the start position (I)

20. An apparatus as defined by claim 19, characterized in that the sliding guide (19) comprises two spaced parallel guide rails (20);

the injectors (23) are each supported between two guide rails (20);

and the guide rails (20) are adjustably supported transversely relative to the path of movement of the shuttles (9).

21. An apparatus as defined by claim 20, characterized in that the guide rails (20) are operatively coupled with the movable guide means (45, 52, 54) and are moved conjointly in dependence on the movement of the shuttles (9).

22. An apparatus as defined by claim 19, characterized in that the injectors (23) are disposed in an array, and adjustably supported transversely relative to the path of movement of the shuttles (9).

23. An apparatus as defined by claim 9 characterized by a thread measurement and supplying apparatus (58) having a continuously driven thread drum (57) located in the path of the thread from a supply to the injectors (23), at least one pressure roller (56, 56*a*) located for selectively engaging the thread against the surface of the drum (57), and means (59) controlling the pressing movement of the rollers (56, 56*a*) in dependence on the movement of injector.

24. An apparatus as defined by claim 9 characterized by a guide tube (70), located to guide the weft thread (24, 24*a*) into the injector (23).

* * * * *

UNITED STATES PATENT AND TRADEMARK OFFICE

CERTIFICATE OF CORRECTION

PATENT NO. : 4,410,017

DATED : October 18, 1983

INVENTOR(S) : Adolf LINKA

It is certified that error appears in the above-identified patent and that said Letters Patent is hereby corrected as shown below:

Col.2,line 4, after "distance" insert -- of --,

Col.7,line 35, change "Fig. 4" to -- (Fig. 4) --,

Col.7,line 50, after "shuttles" insert -- 9 --.

Col.10,line 19 (claim 1) change "to the position" to -- to the start position --, Col.10,line 31 (claim 4) change "outset" to -- start --.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*